US007315705B2

(12) United States Patent
Yasui et al.

(10) Patent No.: US 7,315,705 B2
(45) Date of Patent: Jan. 1, 2008

(54) IMAGE FORMING APPARATUS FOR PREVENTING PAPER SCRATCHING

(75) Inventors: Kazumasa Yasui, Arakawa-ku (JP); Masaya Arakawa, Hiratsuka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 118 days.

(21) Appl. No.: 11/232,901

(22) Filed: Sep. 23, 2005

(65) Prior Publication Data

US 2006/0204264 A1 Sep. 14, 2006

(30) Foreign Application Priority Data

Mar. 9, 2005 (JP) ..... 2005-065576

(51) Int. Cl.
*G03G 15/20* (2006.01)
*G03G 15/00* (2006.01)
*B65H 29/00* (2006.01)

(52) U.S. Cl. ..... 399/68; 399/401; 271/186

(58) Field of Classification Search ..... 399/67, 399/68, 322, 401; 271/186, 270
See application file for complete search history.

(56) References Cited

U.S. PATENT DOCUMENTS 5,629,762 A * 5/1997 Mahoney et al. ..... 271/186 X
5,905,934 A * 5/1999 Koshimizu ..... 399/401 X
6,402,133 B1 * 6/2002 Miyake ..... 271/186 X
6,626,428 B2 9/2003 Soga et al.
6,644,652 B1 * 11/2003 Walsh et al. ..... 271/186
6,931,230 B2 8/2005 Yasui
7,130,574 B2 * 10/2006 Carter et al. ..... 399/401
2003/0062671 A1 4/2003 Yasui et al.

FOREIGN PATENT DOCUMENTS

JP 05-286631 A 11/1993
JP 06-156852 A 6/1994
JP 07-267454 A 10/1995

OTHER PUBLICATIONS

U.S. Appl. No. 11/232,944, filed Sep. 23, 2005, Yasui et al.
U.S. Appl. No. 11/260,271, filed Oct. 28, 2005, Arakawa et al.
U.S. Appl. No. 11/260.387, filed Oct. 28, 2005, Yasui et al.
U.S. Appl. No. 11/176,380, filed Jul. 8, 2005, Yasui.

* cited by examiner

*Primary Examiner*—Sandra L. Brase
(74) *Attorney, Agent, or Firm*—Foley & Lardner LLP

(57) ABSTRACT

An image forming apparatus is provided that prevents paper from being scratched by a peeling claw and reducing the curl amount of the paper to be re-fed to a lower level. The rotational speed of a fixing and discharging roller is adequately kept higher than the rotational speed of a heating roller so as not to allow image stain to be produced in a paper due to scratching by a peeling claw in a fixing unit. Simultaneously, the rotational speed of reverse feeding rollers is set slightly higher than the rotational speed of the heating roller at the time when an automatic duplex unit performs paper re-feeding. As a result, "swelling" of the paper occurring in a reverse gate is eliminated by the reverse feeding roller which is rotated at a speed higher than the heating roller, thereby greatly reducing "curl amount" remaining in the paper due to the "swelling".

8 Claims, 6 Drawing Sheets

Prior Art

Prior Art

IMAGE FORMING APPARATUS FOR PREVENTING PAPER SCRATCHING

This application claims priority from Japanese Patent Application 2005-65576, filed Mar. 9, 2005, which is incorporated herein by reference in its entirety.

BACKGROUND OF THE INVENTION

1. Field of the Invention

The present invention relates to an image forming apparatus and, more particularly, to an image forming apparatus such as a digital copying machine or a printer.

2. Description of the Related Art

FIG. 4 is a cross-sectional view showing a part of a fixing unit and an automatic duplex unit (ADU) of a conventional image forming apparatus. A printing paper PP onto which a toner image has been transferred from a photoconductor drum disposed in a toner image forming section is subjected to fixing processing performed by a heating roller 133 and a pressure roller 134 of the fixing unit 130 and fed to a fixing and discharging roller 135. The fixing and discharging roller 135 then feeds the received printing paper PP to a reverse gate 136.

In the case where a printing paper PP onto only one side of which a toner image has been transferred is reversed and discharged outside the machine, the reverse gate 136 feeds the printing paper PP received from the fixing and discharging roller 135 toward a paper re-feeding route 132*a*. In this case, the printing paper PP is fed through a feeding path that turns at an acute angle (in FIG. 4, turns at right angles) from the fixing and discharging roller 135 toward the paper re-feeding route 132*a*. The printing paper PP guided by the paper re-feeding route 132*a* is fed in a switchback manner by reverse feeding rollers 137*a* and 137*b* toward a printed paper discharge port 131.

In the case where duplex printing is performed, when a toner image has been transferred onto only one side of the printing paper PP, the reverse gate 136 feeds the printing paper PP received from the fixing and discharging roller 135 toward the paper re-feeding route 132*a* as in the above case. The printing paper PP guided by the paper re-feeding route 132*a* is fed in a switchback manner by the reverse feeding rollers 137*a* and 137*b* toward an automatic duplex unit 170. The automatic duplex unit 170 feeds the printing paper PP that has been fed thereto in a switchback manner toward the toner image forming section for paper re-feeding using reverse feeding rollers 137*c* and 137*d*.

In the case where one-side printing or duplex printing for the printing paper PP has been completed as instructed and where the printing paper PP is to be discharged outside the machine without being reversed, the reverse gate 136 directly guides the printing paper PP that has been fed from the fixing and discharging roller 135 to the printed paper discharge port 131.

FIG. 5 schematically shows the state where the printing paper fed from the fixing and discharging roller 135 toward the paper re-feeding route 132*a* in an easy-to-understand manner. In the conventional machine, a rotational speed V3 of the reverse feeding roller 137 (137*a*, 137*b*, 137*c*, 137*d*) is set equal to a rotational speed V1 of the heating roller 133 and pressure roller 134. Only a rotational speed V2 of the fixing/discharge roller 135 is set higher than the V1 and V3. The reason that only the rotational speed V2 is set higher is to prevent image stain from being produced when the printing paper is scratched by a peeling claw disposed in the fixing unit (refer to, for example, Jpn. Pat. Appln. Laid-Open Publication No. 6-156852 (pages 3 to 6, FIG. 1) and Jpn. Pat. Appln. Laid-Open Publication No. 7-267454 (pages 4 to 7, FIG. 1)).

However, in the conventional image forming apparatus, the leading end of the printing paper fed toward the reverse gate 136 hits against the reverse gate 136 to generate early "swelling" (refer to FIG. 5). When the printing paper is passed through the reverse gate 136 and is further fed, this "swelling" moves to the rear side of the printing paper, with the result that the "swelling" remains at the rear side portion of the printing paper as "bending" or "curl". In the case where the printing paper is reversed and re-fed to the toner image forming section, the "curl" stands at the leading end of the printing paper. In this case, when the printing paper has a bigger size and smaller thickness, the "curl" is likely to become greater.

Here, curl amount in an LD size printing paper was measured under the condition that V1 and V3 were set to 420 mm/sec, V2 was set to 448 mm/sec or 429 mm/sec, and rotational speed V3 of reverse feeding roller/rotational speed V2 of fixing and discharging roller was changed by ±4%. As a result, the data as shown in the following Table 1 was obtained. In this case, V2H denotes the case where V2 is 448 mm/sec, and V2L denotes the case where V2 is 429 mm/sec.

TABLE 1

| V3/V2 (%) | V2H (mm) | V2L (mm) |
|---|---|---|
| −3.9 | — | — |
| −3.7 | — | 16 |
| −3.0 | — | 13 |
| −2.2 | 38 | 11 |
| −1.5 | 22 | 9 |
| −0.7 | 18 | 11 |
| +0.1 | 10 | 10 |
| +1.0 | 8 | 10 |
| +1.7 | 5 | 10 |
| +4.0 | 5 | 9 |

FIG. 6 is a graph showing the measurement result corresponding to Table 1. As can be seen from Table 1 and graph of FIG. 6, the smaller the value of rotational speed V2 of the fixing and discharging roller, the smaller the curl amount becomes (when V3/V2 (%) becomes a positive value, curl amount is reduced). That is, the decrease in the rotational speed of V2 of the fixing and discharging roller reduces the curl amount, with the result that it is possible to keep the shape of the printed printing paper in an original state. On the other hand, the decrease in the rotational speed of V2 of the fixing and discharging roller may allow the printing paper to be scratched by the peeling claw disposed in the fixing unit, producing image stain. As another means that reduces the curl amount, special equipment such as a dedicated de-curling unit or a heat pipe has been utilized.

SUMMARY OF THE INVENTION

The present invention has been made to solve the above problem, and an object thereof is to provide an image forming apparatus capable of adequately keeping the rotational speed of the fixing and discharging roller higher than the rotational speed of the heating roller so as not to allow image stain to be produced in the printing paper due to scratching by the peeling claw disposed in the fixing unit and, at the same time, capable of reducing the curl amount of the printing paper after paper re-feeding operation to a lower level without additionally providing special equipment.

To solve the above problem, according to an aspect of the present invention, there is provided an image forming apparatus comprising: a heating roller that fixes a toner image that has been transferred onto a sheet to the sheet; a fixing and discharging roller that feeds the sheet onto which the toner image has been fixed to a next process; a reverse feeding roller that feeds the sheet fed from the fixing and discharging roller to a reverse feeding path in a switchback manner; and a drive control section that controls drive of the heating roller, fixing and discharging roller, and reverse feeding roller such that a relation between the first speed V1, the second speed V2, and the third speed V3 which are determined by the respective rollers satisfies V1<V3<V2.

With the above configuration, even when the sheet is fed from the fixing and discharging roller to the reverse feeding path and the feeding direction of the sheet is changed to the reverse feeding path, "swelling" produced in the reverse gate is eliminated by the reverse feeding roller which is rotated at a speed higher than the heating roller, thereby greatly reducing "curl amount" ultimately remaining in the printing paper due to the "swelling".

Further, in the image forming apparatus having the above configuration, it is preferable that the drive control section set the second speed V2 higher than the first speed V1 by several percent and set the third speed V3 higher than the first speed V1 by 0.2 to 3.6%.

Further, in the image forming apparatus having the above configuration, it is more preferable that the drive control section set the second speed V2 higher than the first speed V1 by several percent and set the third speed V3 higher than the first speed V1 by 0.5 to 1.7%.

Further, in the image forming apparatus having the above configuration, it is preferable that the drive control section set the first speed V1 to 420 mm/sec, the second speed V2 to 448 mm/sec, and the third speed V3 to 425 mm/sec.

As described above in detail, according to the present invention, even when the direction of the printing paper fed from the fixing and discharging roller to the reverse gate is changed by the reverse gate to the paper re-feeding path, the "swelling" to be produced in the reverse gate is eliminated by the reverse feeding roller which is rotated at a speed higher than the heating roller, thereby greatly reducing "curl amount" ultimately remaining in the printing paper due to the "swelling". That is, it is possible to reduce the curl amount of the printing paper after paper re-feeding operation to a lower level without adding special equipment while adequately keeping the rotational speed of the fixing and discharging roller higher than the rotational speed of the heating roller so as not to allow image stain to be produced in the printing paper due to scratching by the peeling claw disposed in the fixing unit.

DETAILED DESCRIPTION OF THE PREFERRED EMBODIMENTS

Figure 1:
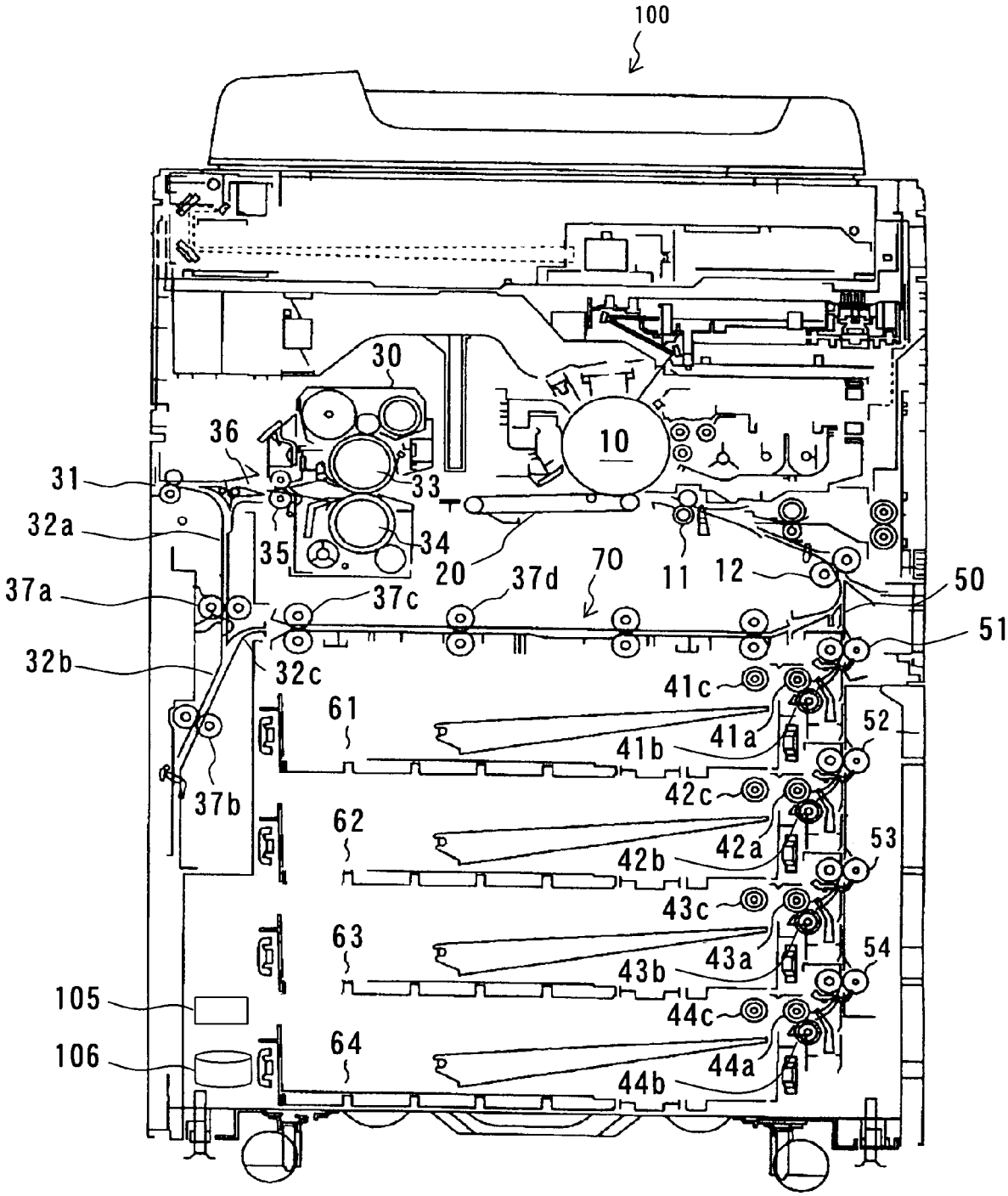
FIG. 1 is a cross-sectional view showing an embodiment of an image forming apparatus according to the present invention.
Figure 2:
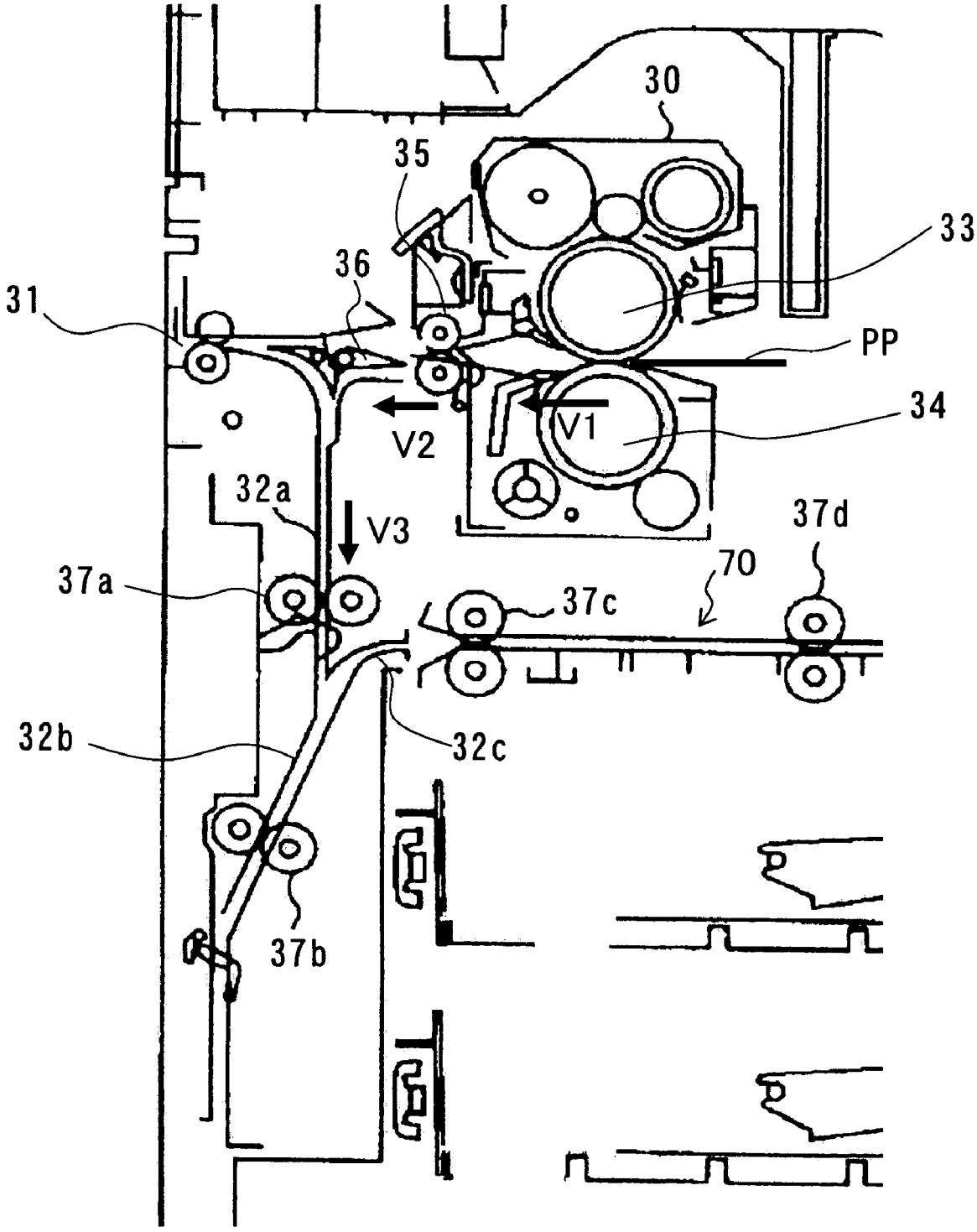
FIG. 2 is a cross-sectional view showing, in an enlarged manner, a part of a fixing section and automatic duplex unit in the image forming apparatus of FIG. 1.
Figure 3:
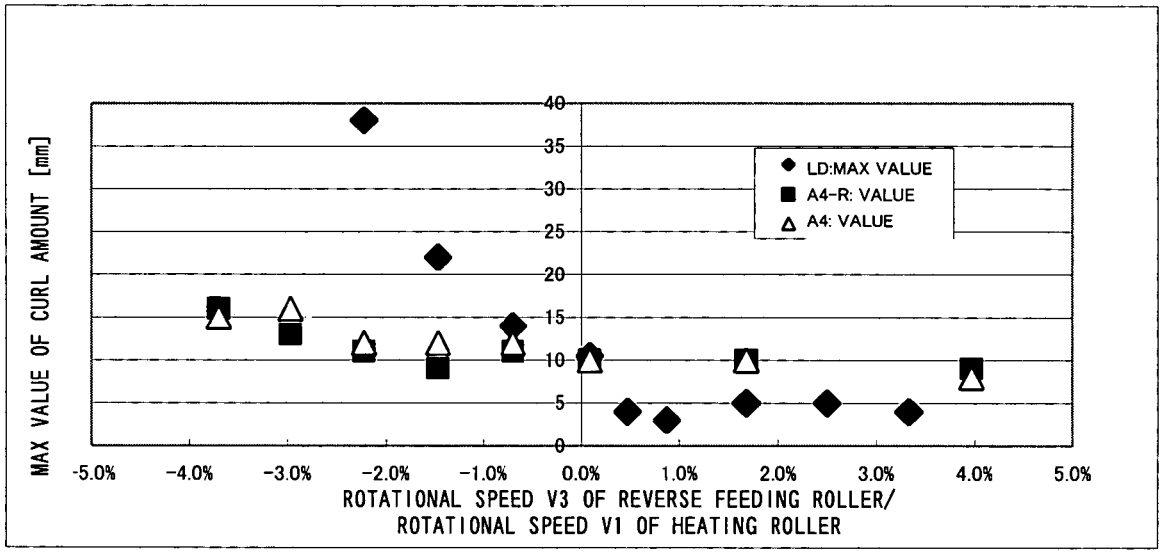
FIG. 3 is a graph showing the curl amount of a printing paper obtained in printing operation of the image forming apparatus shown in FIGS. 1 and 2 which involves paper re-feeding operation, in which a speed ratio between a heating roller and reverse feeding roller is changed in the range of ±4%.
Figure 4:
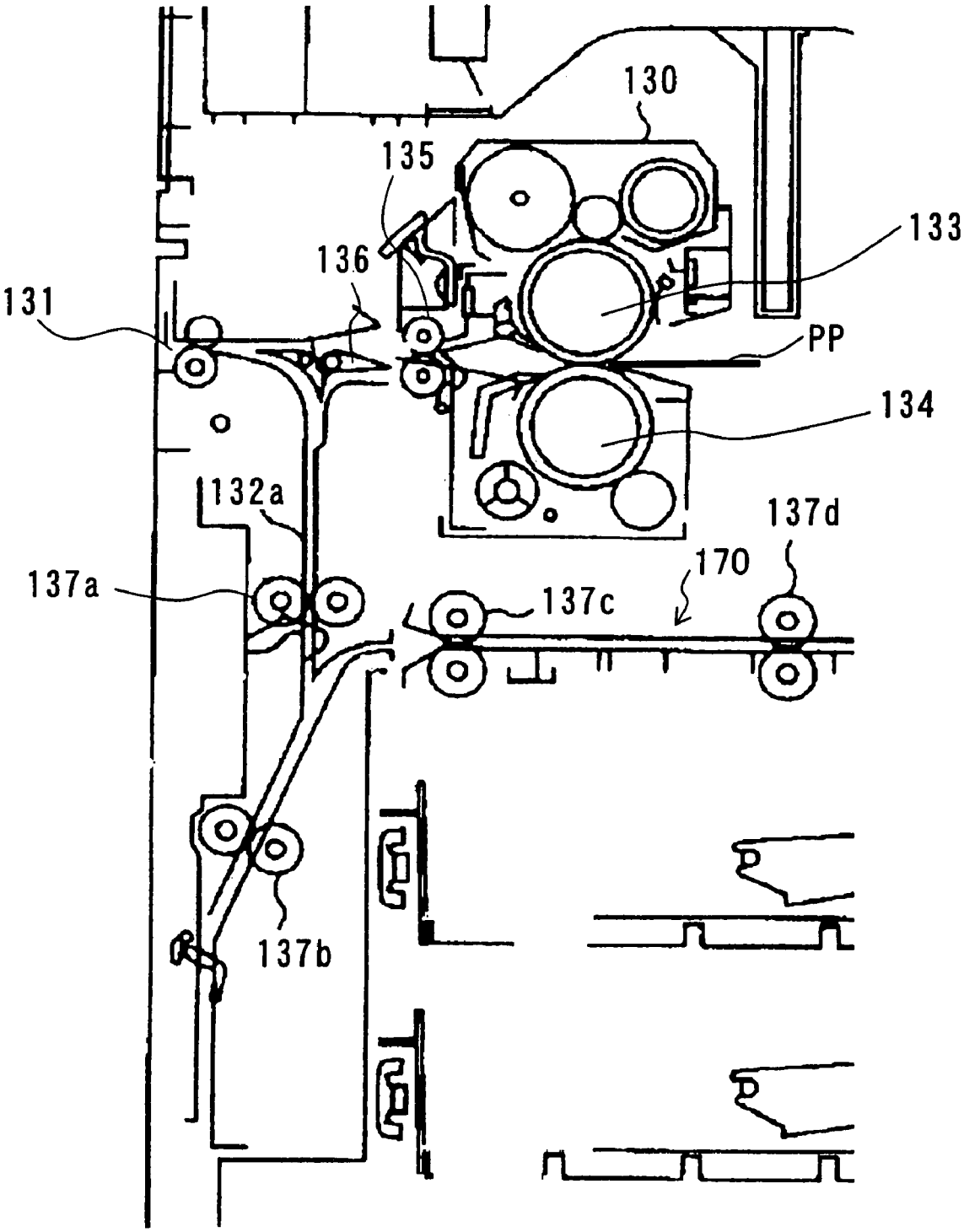
FIG. 4 is a cross-sectional view showing a part of a fixing section and automatic duplex unit in a conventional image forming apparatus.
Figure 5:
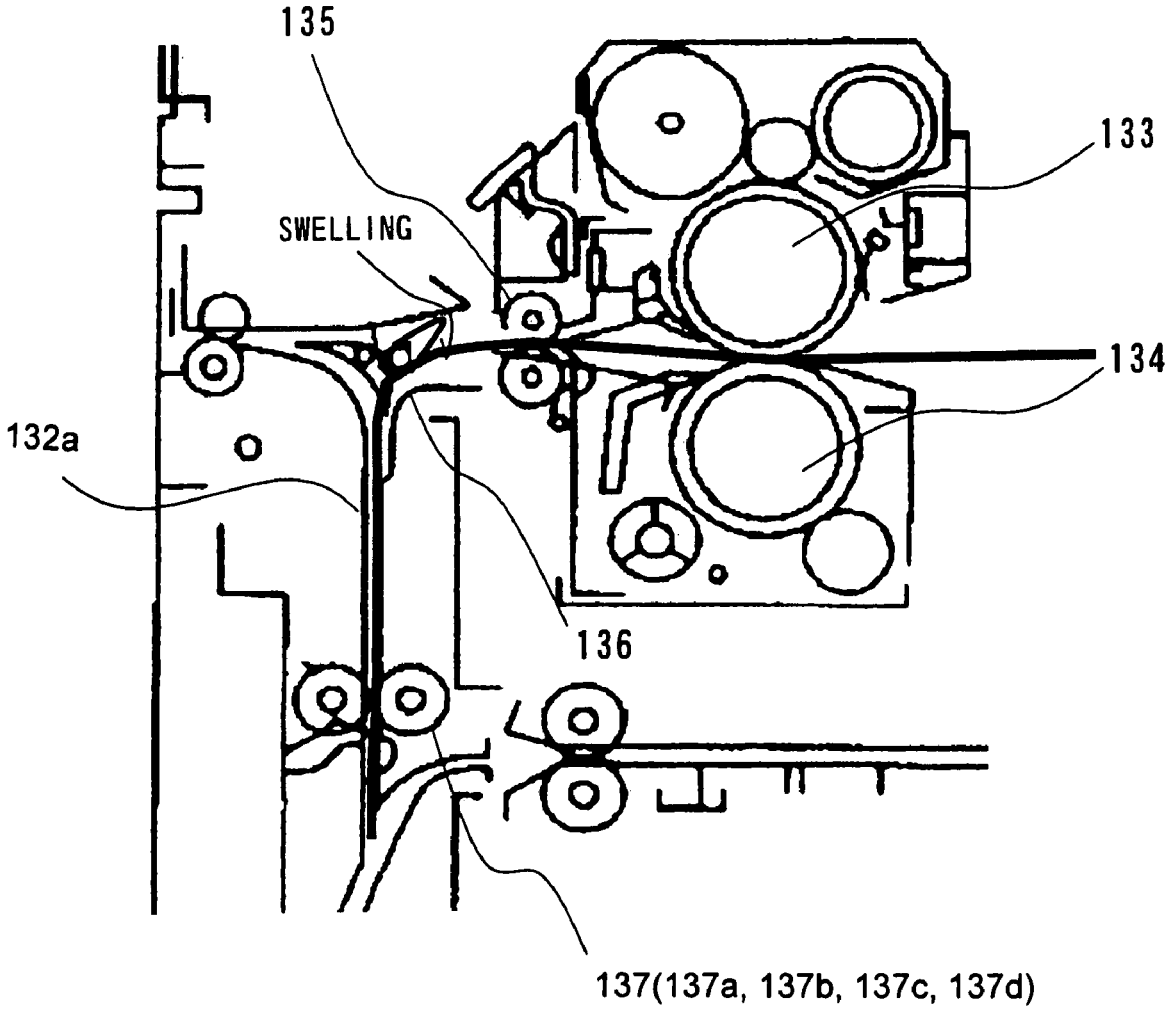
FIG. 5 is a schematic view help explain the description related to FIG. 4 in an easy-to-understand manner.
Figure 6:
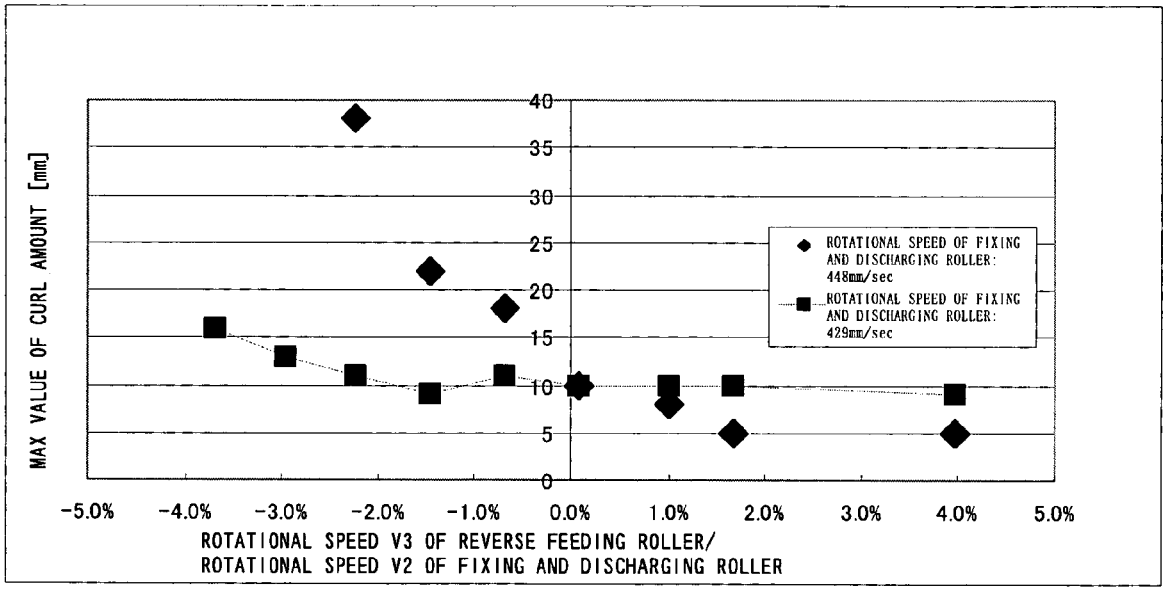
FIG. 6 is a graph showing a result obtained when duplex printing is performed for an LD size printing paper with rotational speed V3 of reverse feeding roller/rotational speed V2 of fixing and discharging roller changed in the range of ±4% and the curl amount after the printing operation is measured.

An embodiment of the present invention will be described below with reference to the accompanying drawings. FIG. 1 is a cross-sectional view showing an embodiment of an image forming apparatus according to the present invention. FIG. 2 is a cross-sectional view showing, in an enlarged manner, a part of a fixing section and automatic duplex unit in the image forming apparatus of FIG. 1. FIG. 3 is a graph showing the curl amount obtained when a speed ratio between a heating roller and reverse feeding roller is changed in the image forming apparatus shown in FIGS. 1 and 2.

An image forming apparatus 100 of FIG. 1 has a toner image forming section including a photoconductor drum 10, a transfer belt 20 that transfers a toner image formed on the photoconductor drum 10 onto a printing paper, a fixing unit 30 that fixes the toner image on the printing paper onto which the toner image has been transferred and which has been fed by the transfer belt 20, a CPU (corresponding to drive controller) 105, and a MEMORY 106.

The image forming apparatus 100 further has a paper feeding mechanism, a paper conveyance mechanism, and an automatic duplex unit 70 (for example, a stackless-type ADU 70). The paper feeding mechanism draws out a printing paper from a plurality of paper feed cassettes that store printing paper of various sizes and sequentially feeds the printing paper one sheet by one sheet to a paper feeding path 50. The paper conveyance mechanism feeds the printing paper that has been fed from the paper feeding mechanism to an aligning position through the paper feeding path 50 at a paper feeding speed and, after aligning control, feeds the printing paper to a transfer nip between the photoconductor drum 10 and transfer belt 20 at a process speed. The automatic duplex unit 70 reverses the printing paper onto only one side of which a toner image has been transferred and re-feeds the printing paper to an aligning position in cooperation with an intermediate feeding roller 12.

The paper feeding mechanism includes paper feed cassettes 61, 62, 63, 64, pick-up rollers 41*c* 42*c*, 43*c*, 44*c*, paper feeding rollers 41*a*, 42*a*, 43*a*, 44*a*, and separating rollers 41*b*, 42*b*, 43*b*, 44*b*. The paper conveyance mechanism includes first, second, third, and fourth feeding rollers 51, 52, 53, 54, an intermediate feeding roller 12, and a resist roller 11. In this case, the intermediate feeding roller 12 is driven by a pulse motor and the CPU 105 controls the intermediate feeding roller 12 such that it can operate at three different speeds of paper feeding speed, process speed, and ADU speed (paper re-feeding speed), that is, the CPU 105 performs three-speed control.

In the present embodiment, the CPU 105 has a role of performing various processing (drive control for respective feeding rollers that perform sheet feeding) in the image forming apparatus and has another role of performing a program stored in the MEMORY 106 to realize various functions. The MEMORY 106 is constituted by, for example, a ROM or RAM and has a role of storing various information and programs utilized in the image forming apparatus.

The above-described fixing unit 30 receives the printing paper PP onto which a toner image has been transferred from the transfer belt 20 and uses a heating roller 33 and pressure roller 34 to fix the toner image on the printing paper PP. The printing paper PP that has been subjected to the fixing processing is fed to a fixing and discharging roller 35, by which the printing paper PP is fed toward a reverse gate 36. In the case where one-side printing or duplex printing for the printing paper PP has been completed as instructed or where the one-side printing paper whose other side will not be subjected to printing has been reversed, the reverse gate 36 feeds the received printing paper PP to a printed paper discharge port 31 in the direction same as the direction that the printing paper PP has been fed thereto since there is no paper re-feeding instruction issued from the controller.

In the case different from the above, that is, in the case where the reverse gate 36 receives an instruction of duplex printing or reverse processing and where only one-side printing has been completed or reverse processing has not been completed, there is a paper re-feeding instruction from the controller, so that the reverse gate 36 feeds the printing paper PP received from the fixing and discharging roller 35 in the direction different from the direction that the printing paper PP has been fed (in the example of FIGS. 1 and 2, the reverse gate 36 feeds the printing paper PP in the direction substantially perpendicular to the direction that the printing paper PP has been fed), that is, toward a paper re-feeding route 32*a*. The automatic duplex unit 70 re-feeds the printing paper PP that has been fed to the paper re-feeding route 32*a* toward the resist roller 11 and toner image forming section through paper re-feeding routes 32*a*, 32*b*, 32*c*. In this case, the printing paper PP that has been fed to the paper re-feeding route 32*a* is fed by reverse feeding rollers 37*a*, 37*b*, 37*c*, 37*d*, and the like disposed along the paper re-feeding route. Note that the reverse feeding rollers 37*a* and 37*b* correspond to the reverse feeding roller recited in the claim.

The heating roller 33 has a role of fixing the toner image transferred onto a sheet to the sheet, the fixing and discharging roller 35 has a role of feeding the sheet onto which the toner image has been fixed, to a next process, and the reverse feeding roller 37 has a role of feeding the sheet that has been fed from the fixing and discharging roller 35 to (at least) the reverse feeding path in order for the sheet to be fed in a switchback manner.

At the paper re-feeding time, in the case of conventional image forming apparatus, the leading end of the printing paper PP is hit against the reverse gate 36 to generate early "swelling". With proceeding of the feeding operation of the printing paper by the reverse feeding roller, this "swelling" moves to the rear side of the printing paper, with the result that the "swelling" remains at the rear side portion of the printing paper. The "swelling" at the rear side of the printing paper becomes "swelling" at the front side of the printing paper at the time when the printing paper PP is reversed and re-fed to the toner image forming section. In this case, when the printing paper PP was discharged from the printed printing paper discharge port 31 after completion of the duplex printing or reverse processing, the "swelling" remained largely as so-called "curl" (in particular, in the case of an LD size printing paper). However, the present inventor succeeded in reducing the "curl" to a very small level in the image forming apparatus 100 shown in FIGS. 1 and 2.

In the image forming apparatus 100, the following experiment was made to reduce the "curl". That is, in order to prevent the printing paper from being scratched by the peeling claw provided in the fixing unit 30, the rotational speed of the fixing and discharging roller 35 was set higher by several percent than the rotational speed of the heating roller 33 and pressure roller 34 as is conventionally done. On the other hand, the rotational speed of the reverse feeding roller 37 was changed in the range of ±4% relative to the rotational speed of the heating roller 33. To be more precise, the rotational speed of the heating roller 33 and pressure roller 34 was set to 420 mm/sec and the rotational speed of the fixing and discharging roller 35 was set to 448 mm/sec. In the above setting, maximum values (mm) of the "curl amount" were measured while the rotational speed of the reverse feeding roller is changed. The following Table 2 shows the result of the measurement. Here, LD, A4-R, A4 size printing papers were used.

TABLE 2

| V3/V1 (%) | MAX value in LD size paper | Max value in A4-R size paper | Max value in A4 size paper |
|---|---|---|---|
| −3.9 | | | |
| −3.7 | — | 16 | 15 |
| −3.0 | — | 13 | 16 |
| −2.2 | 38 | 11 | 12 |
| −1.5 | 22 | 9 | 12 |
| −0.7 | 14 | 11 | 12 |
| +0.1 | 11 | 10 | 10 |
| +0.5 | 4 | — | — |
| +0.9 | 3 | — | — |
| +1.7 | 5 | 10 | 10 |
| +2.5 | 5 | — | — |
| +3.3 | 4 | — | — |
| +4.0 | — | 9 | 8 |

FIG. 3 is a graph showing the result corresponding to Table 2. As can be seen from Table 2 and graph of FIG. 3, the "curl amount" is reduced to a lower level when V3/V1 (%) falls within the range of from +0.5% to +3.3%. In particular, the "curl amount" of the LD size printing paper is reduced to a very low level when V3/V1 (%) is 0.9%. Additionally, duplex printing was performed with the rotational speed of the heating roller 33 and pressure roller 34 set to 420 mm/sec, the rotational speed of the fixing and discharging roller 35 set to 448 mm/sec, and the rotational speed of the reverse feeding roller 37 set to 425 mm/sec. As a result, a highly favorable result was obtained with regard to the "curl amount" (3 mm).

In the present embodiment, when the heating roller 33 feeds a sheet at a feeding speed of 420 mm/sec, the drive control section (CPU 105) performs drive control in such a manner to make the sheet feeding speed determined by the reverse feeding roller 37 higher than the feeding speed determined by the heating roller 33 by about 1 to 15 mm/sec (that is, the feeding speed V3 determined by the reverse feeding roller is made higher than the sheet feeding speed V1 by 0.1 to 4.0% of the V1). In order to further reduce the occurrence of the curl of the sheet, it is preferable that the third speed V3 be made higher then the first speed V1 by 0.2 to 3.6% of the V1. As a matter of course, in order to further reduce the curl amount in the sheet, it is possible for the drive control section to make the second speed V2 higher than the first speed V1 by several percent and the third speed V3 higher than the first speed V1 by 0.5 to 1.7% of the V1 (refer to FIG. 3).

As described above, in the image forming apparatus according to the embodiment of the present invention, the drive control section (CPU 105) controls drive of the heating roller, fixing and discharging roller, and reverse feeding roller such that a relation between the first speed V1, the second speed V2, and the third speed V3 which are determined by the respective rollers satisfies V1<V3<V2.

This application claims priority from Japanese Patent Application 2005-65576, filed Mar. 9, 2005, which is incorporated herein by reference in its entirety.

What is claimed is:

1. An image forming apparatus comprising:

a heating roller that fixes a toner image that has been transferred onto a sheet to the sheet;

a fixing and discharging roller that feeds the sheet onto which the toner image has been fixed to a next process;

a reverse feeding roller that feeds the sheet fed from the fixing and discharging roller to a reverse feeding path in a switchback manner; and a drive control section that controls drive of the heating roller that rotates at a first speed V1, fixing and discharging roller that rotates at a second speed V2, and reverse feeding roller that rotates at a third speed V3 such that a relation between the first speed V1, the second speed V2, and the third speed V3 which are determined by the respective rollers satisfies V1<V3<V2.

2. The image forming apparatus according to claim 1, wherein the drive control section sets the second speed V2 higher than the first speed V1 by several percent and sets the third speed V3 higher than the first speed V1 by 0.2 to 3.6%.

3. The image forming apparatus according to claim 1, wherein the drive control section sets the second speed V2 higher than the first speed V1 by several percent and sets the third speed V3 higher than the first speed V1 by 0.5 to 1.7%.

4. The image forming apparatus according to claim 3, wherein the drive control section sets the first speed V1 to 420 mm/sec, the second speed V2 to 448 mm/sec, and the third speed V3 to 425 mm/sec.

5. An image forming method, comprising the steps of:

fixing a toner image that has been transferred onto a sheet to the sheet;

feeding the sheet onto which the toner image has been fixed to a next process;

reverse feeding the sheet fed from a fixing and discharging roller to a reverse feeding path in a switchback manner; and controlling a drive of the fixing step that operates at a first speed V1, the feeding step that operates at a second speed V2, and the reverse feeding step that operates at a third speed V3 such that a relation between the first speed V1, the second speed V2, and the third speed V3 which are determined by the respective rollers satisfies V1<V3<V2.

6. The image forming method according to claim 5, wherein in the controlling step the second speed V2 is set higher than the first speed V1 by several percent and the third speed V3 is set higher than the first speed V1 by 0.2 to 3.6%.

7. The image forming method according to claim 5, wherein in the controlling step the second speed V2 is set higher than the first speed V1 by several percent and the third speed V3 is set higher than the first speed V1 by 0.5 to 1.7%.

8. The image forming method according to claim 7, wherein in the controlling step the first speed V1 is set to 420 mm/sec, the second speed V2 is set to 448 mm/sec, and the third speed V3 is set to 425 mm/sec.

* * * * *